United States Patent [19]

Koike

[11] Patent Number: 4,781,040

[45] Date of Patent: Nov. 1, 1988

[54] LATCH NEEDLE FOR KNITTING MACHINE

[75] Inventor: Fuji Koike, Nagoya, Japan

[73] Assignee: Loyal Kogyo Kabushiki Kaisha, Japan

[21] Appl. No.: 69,738

[22] Filed: Jul. 6, 1987

[30] Foreign Application Priority Data

| | | | |
|---|---|---|---|
| Jul. 4, 1986 | [JP] | Japan | 61-103510[U] |
| Sep. 16, 1986 | [JP] | Japan | 61-141026[U] |
| Sep. 16, 1986 | [JP] | Japan | 61-141027[U] |

[51] Int. Cl.[4] ..... D04B 35/04

[52] U.S. Cl. ..... 66/121; 66/122

[58] Field of Search ..... 66/121, 122, 123, 124, 66/116, 119

[56] References Cited

U.S. PATENT DOCUMENTS

| | | | |
|---|---|---|---|
| 2,711,218 | 6/1955 | Vitoux | 66/122 |
| 3,453,845 | 7/1969 | Blackwell | 66/121 |
| 3,459,009 | 8/1969 | Wiederhut et al. | 66/122 |
| 4,548,056 | 10/1985 | Schuler | 66/121 |

FOREIGN PATENT DOCUMENTS

| | | | |
|---|---|---|---|
| 1026914 | 3/1958 | Fed. Rep. of Germany | 66/121 |
| 1271113 | 7/1961 | France | 66/122 |

*Primary Examiner*—Ronald Feldbaum

*Attorney, Agent, or Firm*—Sughrue, Mion, Zinn, Macpeak, and Seas

[57] ABSTRACT

Disclosed is a latch needle for knitting machine to be readily assembled from a latch having a pair of transversely protruded pivots and plastically formed from a synthetic resin, as well as an extended needle body consisting of a shank portion. A hook portion is formed at one end thereof and a butt portion at the other end, in which said shank portion has a slot defined by opposite side walls, each having a hole for engagement with each of said pivots. A pair of slanted bottom walls receive said latch for angular movement, which is also plastically formed from the synthetic resin. Owing to slanted face formed on said pivots or said side walls, the latch may be pushed or stricken down in the slot with resiliently spreading the side walls.

6 Claims, 5 Drawing Sheets

LATCH NEEDLE FOR KNITTING MACHINE

BACKGROUND OF THE INVENTION

The invention relates generally to a latch needle for a knitting machine, and more particularly to the knitting needle to be assembled from an extended needle body and a latch respectively plastically formed from a synthetic resin.

There have been proposed and actually used various latch needles for knitting, but it is generally common to all of them that the needle comprises an extended needle body consisting of a shank portion, a hook portion formed at one end thereof and a butt portion at the other end, as well as a latch pivotably mounted in a slot formed in said shank portion at the root of said hook so as to angularly move by an angle of about 165°-170° alternately between a hook open position and a hook closed position.

In order to solve various problems or troubles caused by such alternate angular movement of the latch, for instance in order to lessen damage to the free end of the latch which is often called the latch spoon and to the side walls defining the slot, some proposals have been made as seen in e.g. U.S. Pat. Nos. 4,294,086 and 4,512,164. In order to assure that the latch will not come to rest beside or underneath the needle head when closing the hook, which is inevitably caused from the lateral mobility of the latch, U.S. Pat. No. 4,498,315 has proposed a countermeasure.

The invention does not lie in the improvements of such nature but intends ready assembly of the latch needle and consequently provide inexpensive latch needles.

In the past the latch needles have been made of a metallic material such as stainless steel, but recently such knitting needles have been made of synthetic resin. A thermoplastic resin of high mechanical strength and some flexibility, among which polyacetal, seems to be most preferable also in view of the moderate cost are marketed. The inventor has not found any printed material to be named here as to such a latch needle.

The latch having a pair of transversely protruded pivots arranged at the root portion thereof is plastically formed from said synthetic resin. Separately therefrom the extended needle body having the slot defined by a pair of cheek walls, each having a hole for engaging with said pivot is plastically formed from the synthetic resin. The width of the latch is slightly smaller than that of said the slot, but the latch integrally formed with oppositely protruded pivots cannot be brought in engagement with said holes formed in the side walls. In assembly the slot width must be spreaded with using a wedge tool and when the latch pivots are fitted in the holes, the tool is withdrawn so that opposite cheek walls are brought into the initial positions owing to the flexibility of the material. Such manual assembly is, however, not so easy particularly when the needle is of fine gauge and thus the slot width is thin.

SUMMARY OF THE INVENTION

An object of the invention is, thus to provide a latch needle for knitting machines to be readily assembled from an extended needle body and a latch respectively plastically formed from a synthetic resin without any necessity of a particular tool.

Other objects and various advantages of the invention will be appreciated by reading the following explanation in more detail to be made hereafter in reference to the accompanying drawings.

DESCRIPTION OF THE PREFERRED EMBODIMENTS

Figure 1:
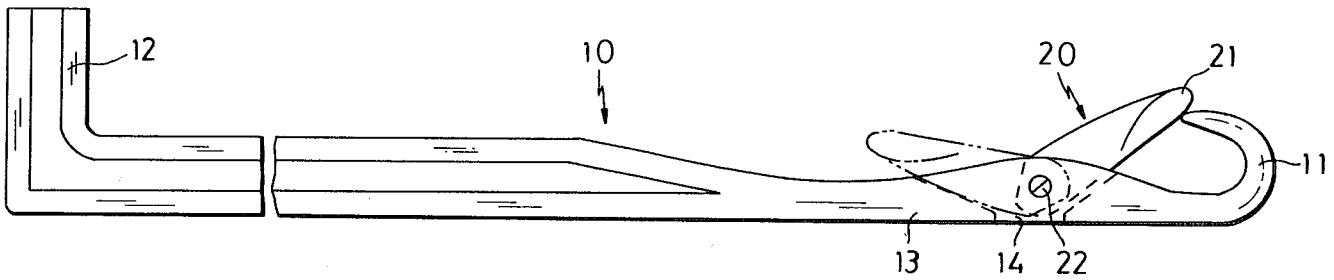
FIG. 1 is a side elevation of the typical latch needle and also the needle of the invention.
Figure 2:
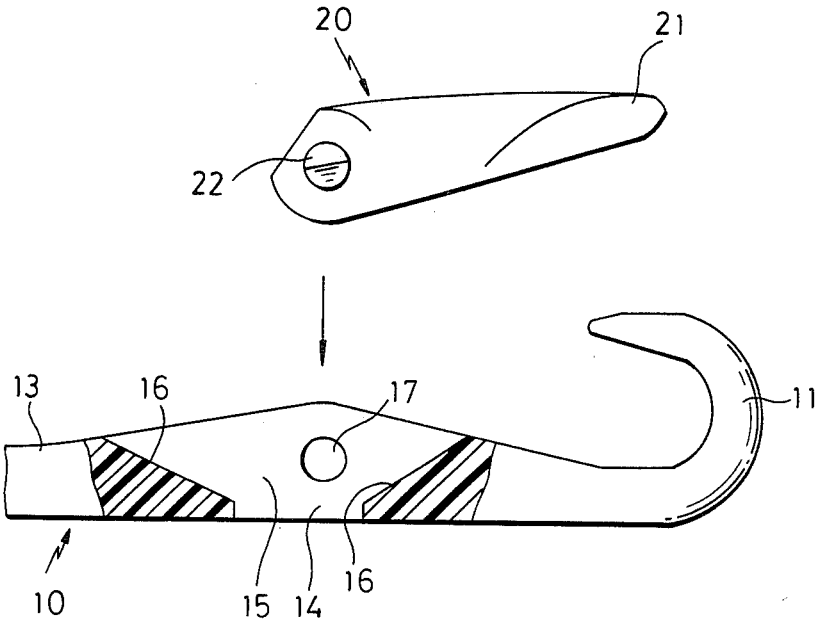
FIG. 2 is a similar view in an enlarged scale of the latch and a part of the elongated needle body before assembly.
Figure 3:
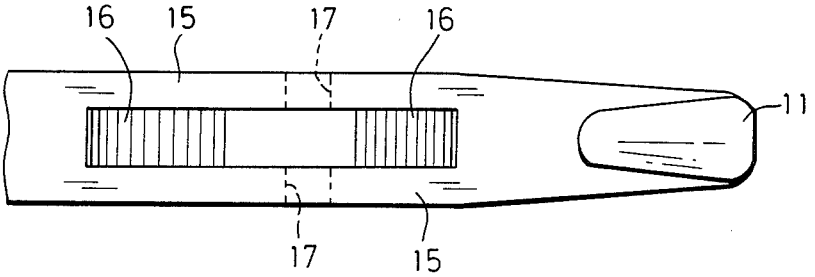
FIG. 3 is a top plan view of a part of said needle body.

With reference to FIG. 1, 2 and 3, an extended needle body represented generally by 10 has a hook portion 11, a butt portion 12 and a shank portion 13 integrally connecting the two portions. A latch represented generally by 20 has a latch spoon 21 at one end thereof and a pair of transversely protruded pivots 22 at the other end.

As best shown in FIG. 2, there is formed a slot 14 in the needle shank 13 in the vicinity of the hook 11. The slot 14 is defined by a pair of cheek walls 15 (FIG. 3) and slanted bottom walls 16. The cheek walls 15, 15 are respectively formed with holes 17 so as to be fitted with the protruded pivots 22 for angular movement of the latch 20 relative to the needle body 10 by an angle of about 165°-170° which is defined by the inclination of said slanted bottom walls 16, 16.

The width of the latch 20 is slightly smaller than that of the slot 14 and the diameter of the pivot 22 is slightly smaller than that of the hole 17 for ensuring smooth angular movement and for preventing the pivot 22 from disengaging out of the hole 17. It is preferable for the cheek wall 15 to be formed in a hill of which top lies above the hole 17. The slot 14 is partly open in general at the bottom thereof.

The latch 20 is angularly moved alternately during the knitting operation, as well known to those skilled in the art, between the position illustrated by solid lines in FIG. 1 where the latch 20 lies on the slanted bottom wall 16 near the hook 11 and the latch spoon 21 rests on the free end of the hook to be closed and the opposite position illustrated by phantom lines where the latch 20 lies on the other slanted bottom wall 16 so as to open the hook, by the angle degree referred to above.

The construction and arrangement themselves explained in the above description have no direct connection with the invention which is characterized in configuration of the pivot and/or concerned portion of the cheek walls particularly formed for the purpose of making the assembly easy.

Figure 4:
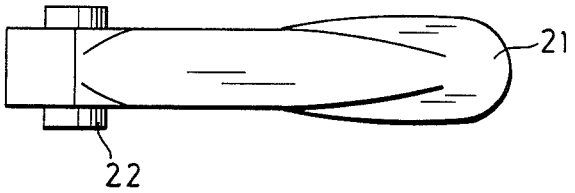
FIG. 4 is also a top plan view but of the latch according to the invention.
Figure 5:
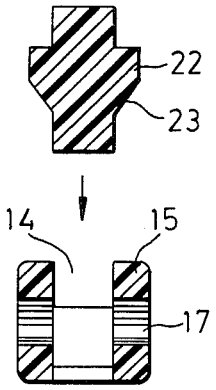
FIG. 5 is a transverse sectional view taken along a line V—V in FIG. 4 and of the concerned portion of the needle body.

Now with reference to FIGS. 4, and 5, each of the protruded pivots 22 has a slanted face 23 at the lower half of the so that the axial length of the pivot is made zero or the width of the latch inclusive of the opposite pivots is made substantially same with the latch itself at the lower end of said slanted face 23. Owing to such configuration of the pivots 22, when the latch 20 is inserted in the slot 14 only with the bottom portion thereof and then pushed or struck down in the direction vertical to the axis of the latch laid along the slanted bottom wall 16 close to the hook 11 and consequently vertical to the surface of said slanted bottom wall (see also FIGS. 1 and 2), the opposite cheek walls 15, 15 are resiliently spreaded with the portion where the holes 17, 17 are formed as the central points by virtue of the wedge action by said slanted face 23 so that the pivots 22, may be fitted in the holes 17, as best shown in FIG. 5.

Figure 6:
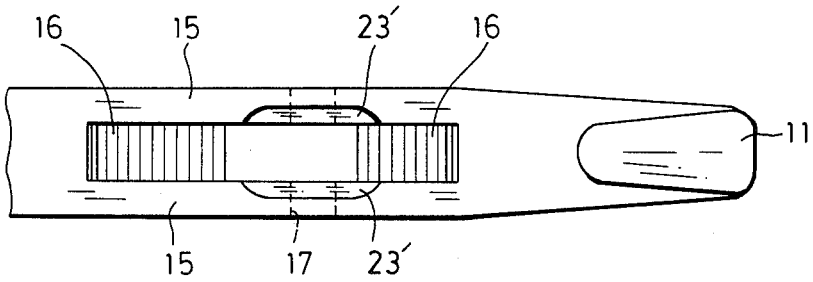
FIG. 6 is a top plan view of the latch according to the second embodiment of the invention.
Figure 7:
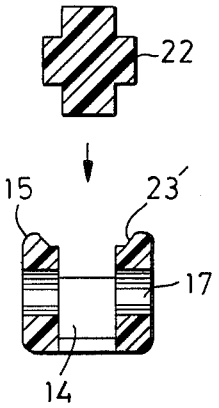
FIG. 7 is a transverse sectional view similar to FIG. 5 but for illustrating said second embodiment.

In reference to FIGS. 6 and 7, the pivots 22, themselves are usual but slanted faces 23' , 23' are formed at the opposite ridge lines where the inner surfaces and the upper surfaces of the opposite cheek walls 15, 15 are respectively crossed. The longitudinal extension of each of the rounded ridge lines 23',23' is to be decided depending on the flexibility of the material of the cheek wall, the thickness thereof, the length of the protruded pivot and so on for realizing the desirable spread of the slot width.

Figure 8:
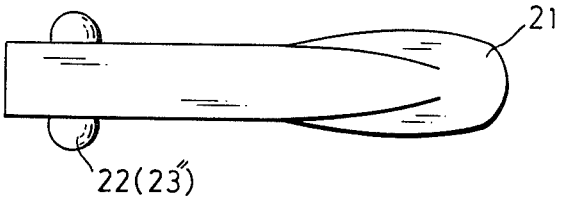
FIG. 8 is a top plan view similar to FIG. 3 but illustrating the third embodiment of the invention.
Figure 9:
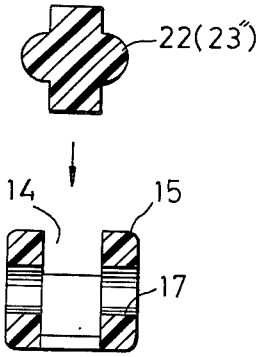
FIG. 9 is a transverse sectional view similar to FIG. 7 but for illustrating said third embodiment.

Finally in reference to FIGS. 8 and 9 each of the pivots 22 is formed to be substantially hemispherical. There will be no need for further explanation on the assembly.

Although there is no particular illustration in the drawings, there may be formed a shallow guide grooves in the inner surface of the cheek wall 15 so that the free end of the pivot 22 may be urgingly moved therealong down to reach the hole 17. Various modifications may be made on the illustrated embodiments by those skilled in the art as occasion demands. For instance, the cheek walls 15, in the first and third embodiments may also have slanted surfaces along the ridge line like as in the second embodiment in FIG. 7.

What is claimed is:

1. Latch needle for knitting machines comprising an extended needle body plastically formed from a synthetic resin and consisting of a shank portion, a hook portion formed at one end thereof and a butt portion at the other end, said shank portion having a slot formed in the vicinity of said hook portion and defined by a pair of side walls, each having a hole, and a pair of oppositely slanted bottom walls; and a latch plastically formed from the synthetic resin and having a latch spoon at one end thereof and a pair of transversely protruded opposite pivots at the other end so that when said pivots are fitted in said holes the latch may be angularly moved alternately between the closed position where said latch lies on one of said slanted bottom wall near to the hook with the latch spoon resting on the free end of the hook and the open position where said latch lies on the other slanted bottom wall remote from the hook by an angle a little smaller than 180° which is defined by the inclination of said slanted bottom walls, in which rounded faces are formed on either of the pivots and the concerned portion of the side walls so that when the latch partly inserted in said slot is urged to move down the side walls are resiliently spreaded owing to wedge action to be caused by said rounded faces so that said pivots may engage with said holes and then the side walls may be brought into the initial positions by virtue of the flexibility of the synthetic resin.

2. Latch needle according to claim 1, in which each of said pivots is formed with a slanted face at the lower half of the free end thereof so that the axial length of the pivot is made zero at the lower end of said slanted face.

3. Latch needle according to claim 1, in which each of said side walls is formed with a rounded face along a ridge line where the inner surface and the upper surface of said side wall are crossed.

4. Latch needle according to claim 1, in which each of said pivots is formed to be substantially hemispherical.

5. Latch needle according to claim 2, in which each of the side walls is formed with a rounded face along a ridge line where the inner and upper surfaces of said side wall are crossed.

6. Latch needle according to claim 4, in which each of the side walls is formed with a rounded face along a ridge line where the inner and upper surfaces of said side wall are crossed.

* * * * *